US010182652B1

(12) United States Patent
Spielmann et al.

(10) Patent No.: US 10,182,652 B1
(45) Date of Patent: Jan. 22, 2019

(54) INTERACTIVE KIOSK SHELVES

(71) Applicant: Google LLC, Mountain View, CA (US)

(72) Inventors: Victoria A. Spielmann, Piedmont, CA (US); Christopher Graham Tewksbury, Fairfax, CA (US); Li Xu, San Francisco, CA (US); Nicholas Joseph Scalzi, San Francisco, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/850,333

(22) Filed: Dec. 21, 2017

(51) Int. Cl.
*A47F 5/00* (2006.01)
*A47B 57/58* (2006.01)
*F16B 1/00* (2006.01)

(52) U.S. Cl.
CPC ..... *A47B 57/58* (2013.01); *A47F 5/005* (2013.01); *A47F 5/0018* (2013.01); *A47F 5/0093* (2013.01); *F16B 1/00* (2013.01); *A47F 2005/0075* (2013.01); *F16B 2001/0035* (2013.01)

(58) Field of Classification Search
CPC ..... A47F 5/005; A47F 5/0093; A47F 5/0018; A47F 2005/0075; A47B 57/58; F16B 1/00; F16B 2001/0035
USPC ..... 211/184, DIG. 1, 135, 186, 134, 187; 108/60, 61, 108, 147.11, 147.17; 220/528–550; 206/350, 818
See application file for complete search history.

(56) References Cited

U.S. PATENT DOCUMENTS 570,657 A * 11/1896 Beckwith ..... A47B 57/58 108/61
919,526 A * 4/1909 Belcher ..... A47B 57/42 108/108
1,100,306 A * 6/1914 Hunt ..... F25D 25/02 211/135
1,839,287 A * 1/1932 Wolfson ..... G02B 6/0043 362/812
1,896,737 A * 2/1933 Zuschlag ..... B61K 9/10 324/217
2,474,036 A * 6/1949 Curley ..... H01F 7/0247 211/69.9
2,516,122 A * 7/1950 Hughes ..... A47B 57/583 108/61
2,998,107 A * 8/1961 Zimmerla ..... A47B 57/425 108/108
3,067,903 A * 12/1962 Jones, Jr. ..... A47F 5/005 206/818
3,301,407 A * 1/1967 Jones ..... A47B 57/586 108/61
3,358,956 A * 12/1967 Thornton ..... A47B 96/062 211/184

(Continued)

*Primary Examiner* — Jonathan Liu
*Assistant Examiner* — Devin K Barnett
(74) *Attorney, Agent, or Firm* — Leason Ellis LLP

(57) ABSTRACT

A shelf unit for a kiosk which is configured to display items includes a plurality of dividers which maintain the items in respective positions on an insert disposed within a recessed top surface of the shelf. The insert includes a magnetically permeable material. A magnetic attraction exists between the dividers and the insert to secure the dividers in position. The dividers are movably positionable on the insert, with each of the dividers including a magnet and shielding material. The shielding material redirects magnetic flux emanating from the magnet toward the insert. The items are seated between the dividers on the insert.

12 Claims, 6 Drawing Sheets

(56) References Cited

U.S. PATENT DOCUMENTS 3,440,527 A * 4/1969 Steingroever ..... G01B 7/105 324/230
4,049,333 A * 9/1977 Wallace ..... B60R 11/0205 211/DIG. 1
4,058,357 A * 11/1977 Wallace ..... B60R 11/0205 211/DIG. 1
4,314,648 A * 2/1982 Spanner ..... A47F 1/12 193/2 R
4,401,986 A * 8/1983 Trenkler ..... G01D 5/204 324/207.15
4,461,388 A * 7/1984 Bustos ..... A47F 7/28 211/184
4,472,682 A * 9/1984 Kuno ..... G01C 17/38 324/228
4,488,653 A * 12/1984 Belokin ..... A47F 5/005 108/61
4,716,841 A * 1/1988 Suttles ..... A47F 5/103 108/108
4,756,430 A * 7/1988 Spanner ..... A47F 7/16 108/108
4,792,051 A * 12/1988 Miller ..... A47F 5/005 108/61
4,881,708 A * 11/1989 Walter ..... A47B 96/02 248/243
4,905,847 A * 3/1990 Hanson ..... A47B 57/58 211/184
5,001,448 A * 3/1991 Srivastava ..... G01R 33/421 324/318
5,349,133 A * 9/1994 Rogers ..... H01B 11/1025 174/106 R
5,490,600 A * 2/1996 Bustos ..... A47B 57/00 211/184
5,505,315 A * 4/1996 Carroll ..... A47F 1/125 211/51
5,577,623 A * 11/1996 Bustos ..... A47B 57/00 108/180
5,673,801 A * 10/1997 Markson ..... A47F 1/126 211/184
6,006,906 A * 12/1999 Winnard ..... B25H 3/06 206/350
6,047,647 A * 4/2000 Laraia, Jr. ..... A47B 57/58 108/61
6,073,766 A * 6/2000 Winnard ..... A45C 13/02 206/350
6,082,557 A * 7/2000 Leahy ..... A47B 57/58 211/184
6,155,438 A * 12/2000 Close ..... A47F 1/125 211/119.003
6,164,462 A * 12/2000 Mumford ..... A47F 5/0093 108/102
6,401,942 B1 * 6/2002 Eckert ..... A47F 1/126 211/184
6,708,627 B1 * 3/2004 Wood ..... A47B 96/02 108/42
6,871,921 B2 * 3/2005 Ernst ..... A47B 88/90 220/529
6,972,649 B1 * 12/2005 Murthy ..... H01H 71/2454 335/176
7,287,652 B2 * 10/2007 Scholen ..... A47F 5/0846 211/26
7,721,362 B2 * 5/2010 Martin ..... E03C 1/186 220/529
7,740,214 B2 * 6/2010 Marsilio ..... A47F 7/024 248/178.1
8,087,522 B2 * 1/2012 Stafford ..... A47F 5/0025 108/108
8,164,853 B2 * 4/2012 Hirata ..... G11B 5/315 360/125.3
8,607,970 B2 * 12/2013 De Lecce ..... A47F 7/024 206/566
8,635,718 B1 * 1/2014 Giagni, Sr. ..... E03C 1/186 4/514
8,727,141 B2 * 5/2014 Akalin ..... A47K 1/09 211/66
8,960,827 B2 * 2/2015 McMillin ..... A47B 96/027 108/108
9,044,089 B1 * 6/2015 Sandhu ..... A47B 88/044
9,386,865 B2 * 7/2016 Bally ..... A47F 3/14
9,486,090 B2 * 11/2016 Juric ..... A47F 5/005
9,615,677 B2 * 4/2017 Trinh ..... A47F 5/0087
9,800,104 B2 * 10/2017 Tanaka ..... C22C 38/00
9,978,295 B1 * 5/2018 Denby ..... G09F 15/0056
2001/0004817 A1 * 6/2001 Auer ..... E04B 2/7438 52/238.1
2001/0045403 A1 * 11/2001 Robertson ..... A47F 1/12 211/59.2
2002/0011838 A1 * 1/2002 Miyata ..... G01D 5/2053 324/207.17
2002/0033373 A1 * 3/2002 Robertson ..... A47F 1/12 211/59.2
2002/0130231 A1 * 9/2002 Winnard ..... B25H 3/04 248/206.5
2003/0136750 A1 * 7/2003 Fujii ..... A47F 5/0093 211/90.02
2004/0055514 A1 * 3/2004 De Land ..... A47B 96/04 108/108
2004/0060884 A1 * 4/2004 Nook ..... A47F 5/0018 211/189
2004/0238466 A1 * 12/2004 Shiao ..... B25H 3/04 211/70.6
2005/0199568 A1 * 9/2005 Gay, II ..... A47F 5/00 211/187
2006/0145577 A1 * 7/2006 Daley ..... A47B 96/021 312/408
2007/0188170 A1 * 8/2007 Bartington ..... G01R 33/04 324/253
2009/0255891 A1 * 10/2009 Lanning ..... A47B 96/04 211/183
2010/0012600 A1 * 1/2010 Clontz ..... A47B 96/02 211/26
2010/0108630 A1 * 5/2010 Breitfeld ..... B65D 5/4804 211/184
2011/0062294 A1 * 3/2011 Johnson ..... A47F 7/024 248/161
2011/0089800 A1 * 4/2011 Nash ..... A47B 96/028 312/404
2012/0285915 A1 * 11/2012 O'Quinn ..... A47B 96/021 211/134
2012/0293924 A1 * 11/2012 Dolci ..... G06F 1/1632 361/679.01
2013/0020270 A1 * 1/2013 Valiulis ..... A47F 5/005 211/59.2
2013/0213911 A1 * 8/2013 Theisen ..... A47F 5/0025 211/59.4
2013/0220947 A1 * 8/2013 Pintur ..... A47F 5/0018 211/1
2014/0151313 A1 * 6/2014 Breslow ..... A47F 1/04 211/59.3
2015/0070928 A1 * 3/2015 Rau ..... G09F 13/18 362/604
2015/0157144 A1 * 6/2015 Lamarre ..... A47B 47/0083 211/135
2015/0173529 A1 * 6/2015 Hester-Redmond ..... A47F 5/08 211/59.3
2015/0351540 A1 * 12/2015 Reinhart ..... A47B 47/0091 211/186
2016/0007737 A1 * 1/2016 Clark ..... B65D 21/0215 211/126.2
2016/0064814 A1 * 3/2016 Jang ..... H01Q 1/526 343/842
2016/0073753 A1 * 3/2016 Tanabe ..... A45C 13/08 150/104
2016/0088941 A1 * 3/2016 Snowbarger ..... A47B 96/021 211/135
2016/0106261 A1 * 4/2016 Cloutier ..... A47J 37/0694 99/425
2016/0166059 A1 * 6/2016 Zohar ..... A47B 81/02 312/257.1

(56) References Cited

U.S. PATENT DOCUMENTS

| | | | | |
|---|---|---|---|---|
| 2016/0174712 | A1* | 6/2016 | Jenkinson | F25D 25/02 211/186 |
| 2016/0183682 | A1* | 6/2016 | Tang | A47B 96/021 211/134 |
| 2016/0217900 | A1* | 7/2016 | Dong | H01F 27/24 |
| 2017/0082388 | A1* | 3/2017 | Plourde | F41A 17/06 |
| 2017/0366078 | A1* | 12/2017 | Zhang | H02K 1/00 |
| 2018/0128538 | A1* | 5/2018 | Jang | A47B 57/30 |

* cited by examiner

INTERACTIVE KIOSK SHELVES

FIELD OF THE INVENTION

The present invention relates to improvements in kiosks and related displays, and, in particular, relates to adaptable shelves that maintain a consistent display appearance which is especially suited for use in kiosks.

BACKGROUND OF THE INVENTION

Computer-enabled interactive kiosks offer retailers the ability to advertise, display products, and provide a wealth of product information, both visual and auditory, in a small, accessible installation. The multi-functionality of such kiosks provides retailers with opportunities to enhance the aesthetic appeal of its product offering for attracting customers, and can also foster a consistent set of visual and auditory features that customers may come to associate with a particular brand. As interactive kiosks are designed for, and often experience, extensive public use, the displayed objects can be moved from their assigned locations and manipulated in ways that change the overall appearance of the kiosk over time, to the detriment of the consistent "look" for which the specifications of the kiosk have been designed. Ways to prevent such detrimental changes to the appearance of the display are therefore sought.

What is therefore needed is an apparatus and method which displays products consistently within a kiosk installation and helps preserve the intended appearance of the kiosk as a whole.

SUMMARY OF THE INVENTION

Embodiments of the present invention provide a shelf unit for a kiosk used for displaying items that comprises a shelf body having a recessed top surface, an insert disposed within the recessed top surface of the shelf body, the insert including a magnetically permeable material, and a plurality of dividers movably positionable on the insert, each of the dividers including a magnet and shielding material, the shielding material redirecting magnetic flux emanating from the magnet toward the insert. The dividers maintain the displayed items in respective positions on the insert while a magnetic attraction between the dividers and the insert secures the dividers in position.

In some implementations, the insert is made of a stainless steel. In certain embodiments, the plurality of dividers is sized dimensioned to be horizontally moveable along the insert while keeping a perpendicular orientation. In addition, the plurality of dividers can be removable from and replaceable onto the insert.

In certain implementations, the display items have approximately a same width and the dividers are positionable on the insert to create uniform slots for placing display items on the shelf therebetween. In other implementations, the display items have varying widths, and a select number of dividers are placeable at locations on the insert to maintain the position of the displayed items in rows on the insert.

Embodiments of the present invention also provide a kiosk for displaying items that comprises an illuminated display unit, a shelf support positioned beneath the illuminated display unit, and one or more shelf units positioned on the shelf support for holding the display items, the one or more shelf units. The one or more shelf units include a shelf body having a recessed top surface, an insert disposed within the recessed top surface of the shelf body, the insert including a magnetically permeable material, and a plurality of dividers movably positioned on the insert, each of the dividers including a magnet and shielding material, the shielding material redirecting magnetic flux emanating from the magnet toward the insert. The dividers maintain the displayed items in respective positions on the insert while a magnetic attraction between the dividers and the insert secures the dividers in position.

In some implementations, the insert of the one or more shelf units is made of a stainless steel. In certain embodiments, the plurality of dividers of the one or more shelf units can be dimensioned to be horizontally moveable along the insert while maintaining a perpendicular orientation relative to the shelf. The dividers of the one or more shelf units can be removable from and replaceable onto the insert.

In certain implementations, the display items held on the one or more shelf units have approximately a same width and the dividers are positionable on the one or more shelf units to create uniform slots for placing display items on the shelf therebetween. In other embodiments, the display items held on the one or more shelf units have varying widths, and a select number of dividers are placeable at locations on the one or more shelf units to maintain the displayed items in rows on the insert.

DETAILED DESCRIPTION CERTAIN OF EMBODIMENTS OF THE INVENTION

The following disclosure describes embodiments of a shelf unit adapted for kiosk displays. The shelf unit includes an insert made of magnetically-permeable material and a plurality of dividers positioned on the insert which are slidably movable horizontally across an upper surface of the insert. The dividers establish slots between one another which can have varying width for receiving and displaying objects therebetween, which a consumer with an interest in the object can readily access. The dividers include a magnet and an internal shield that redirects magnetic flux emanating from the magnet in a downward direction to establish forcible attraction with the magnetically-permeable insert. Accordingly, dividers which have been placed at particular horizontal positions on the insert generally adhere to the insert unless purposefully moved (e.g., manually by a force that overcomes the magnetic attractive force). In some embodiments, the magnets within the dividers are partially covered with a magnetically-permeable material (e.g., ferromagnetic material) at which magnetic flux lines emanating from the magnet are severely attenuated or possibly terminate, preventing magnetic coupling with any displayed objects, such as electronic devices, through the areas covered by the ferromagnetic material.

Figure 1:
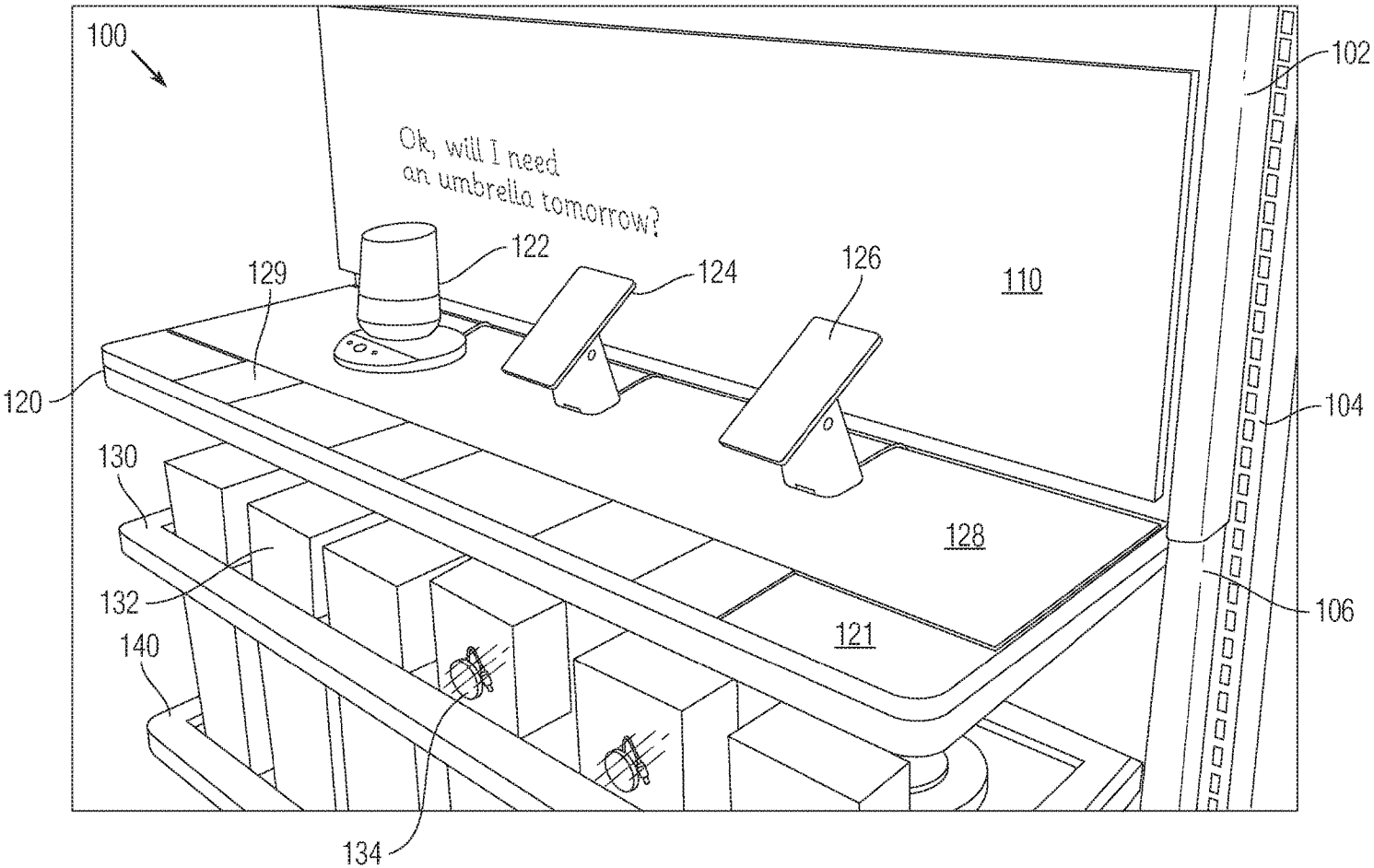
FIG. 1 is a perspective view of an interactive kiosk including shelf units according to an embodiment of the present invention.

FIG. 1 is a perspective view of an embodiment of an interactive kiosk 100 that includes shelf units according to the present invention. Interactive kiosk 100 includes an upright header panel 102 that is securely attached to one or more brackets 104, through which the kiosk can be attached to a wall. At the top portion of the kiosk an interactive vertically-oriented LED display 110 is mounted on or otherwise supported on the header panel 102. In the embodiment depicted, LED display 110 comprises a vertical screen behind which one or more LED units (not explicitly shown) is situated. The LEDs of the display are programmed to display images or alphanumeric data preferably related to intended purpose of the kiosk display. The screen softens the illumination effect of the LEDs, producing a soothing aesthetic effect. Beneath the header panel 102 and vertical LED display 110 is positioned a base unit which includes a backing 106 that supports several shelf units 120, 130, 140 in a cantilevered manner. The top shelf 120 has a top surface 121 ("platform") which supports the display of promoted items and products via holders 122, 124, 126 and, in some implementations, an additional horizontal LED display 128. Platform 121 and holders 122, 124, 126 can be color-coordinated with the LED display 110 as shown. Information regarding the products promoted can be posted on the LED displays 110, 128, and can be captioned on a legend 129 positioned at the front of the platform 121. The horizontal LED display 128 can operate in coordination with vertical LED display 110 to display similar and/or complementary information.

Figure 2:
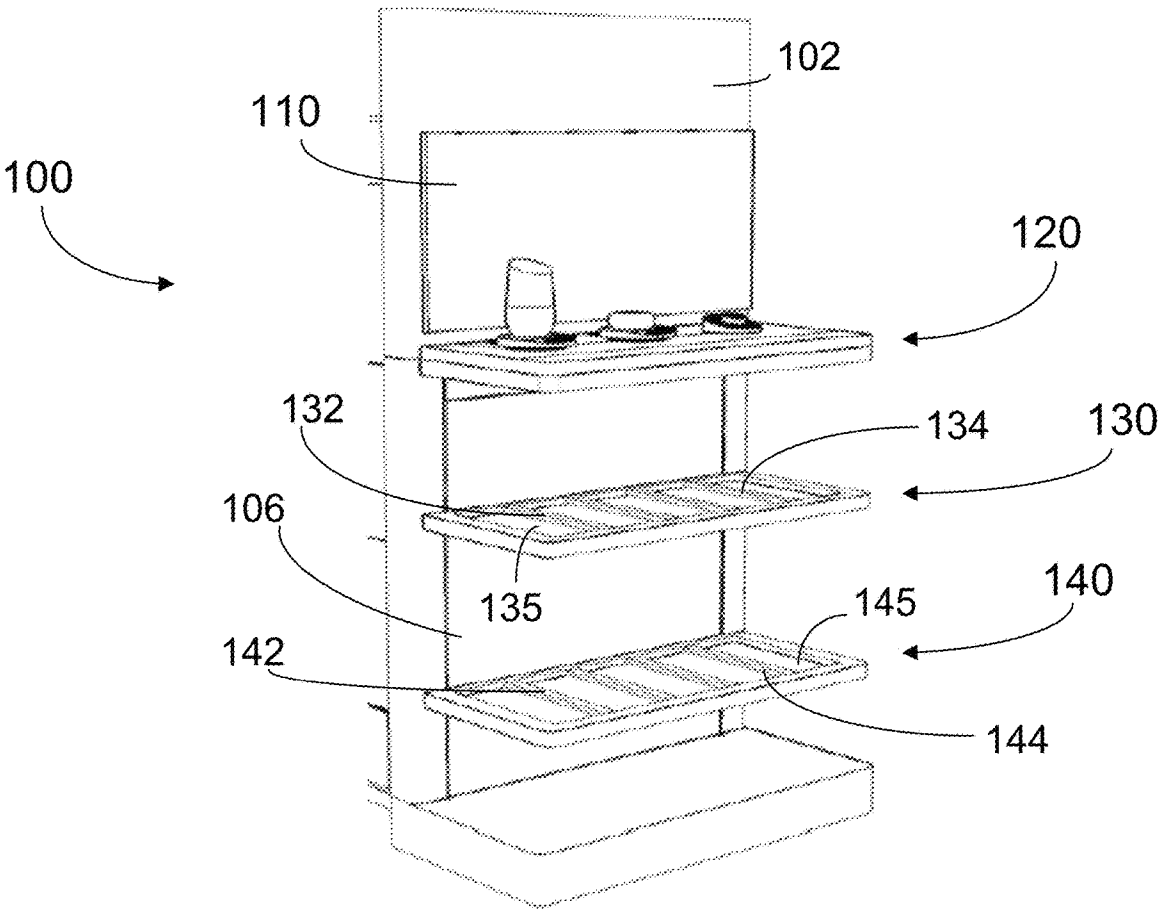
FIG. 2 is another perspective view of the interactive kiosk including shelf units according to an embodiment of the present invention depicting the lower shelves without displayed items.

Lower shelves 130, 140 are designed to provide an orderly display of items, for example, packaged versions of the products promoted and displayed on the platform 121. The lower shelves 130, 140 are particularly adapted with specific features for this purpose. As shown in FIG. 1, shelf 130 supports a number of display items e.g., 132, 134. FIG. 2 is a perspective view of the interactive kiosk 100 from which display items have been removed to reveal the features of the lower shelves 130, 140 more clearly. The display items can be packaged products for sale or any other item selected for display at the kiosk. As shown, shelf 130 has a top surface that is inset, recessed beneath the level of the outer edges of the shelf. An insert 135 is positioned within the top surface recess. A plurality of divider elements ("dividers"), e.g., 132, 134, is positioned and oriented in a front to rear alignment, i.e., perpendicular to the horizontal dimension along the width of the shelf. The dividers 132, 134 are dimensioned so as occupy only a small portion of the horizontal space of the shelf, and to be able to be moved horizontally along the insert while maintaining their alignment within the recess. In some implementations, the dividers are about 29 to about 31 cm in length, about 1.0 to about 3.0 cm in width, and about 1.0 to about 3.0 cm in height. Shelf 140 similarly includes insert 145 and dividers e.g., 142, 144. The dividers on both shelves 130, 140 are removable from the shelves and are also replaceable, allowing the number of dividers included on a shelf to be set according to a preselected number of rows of items to be displayed.

Figure 3:
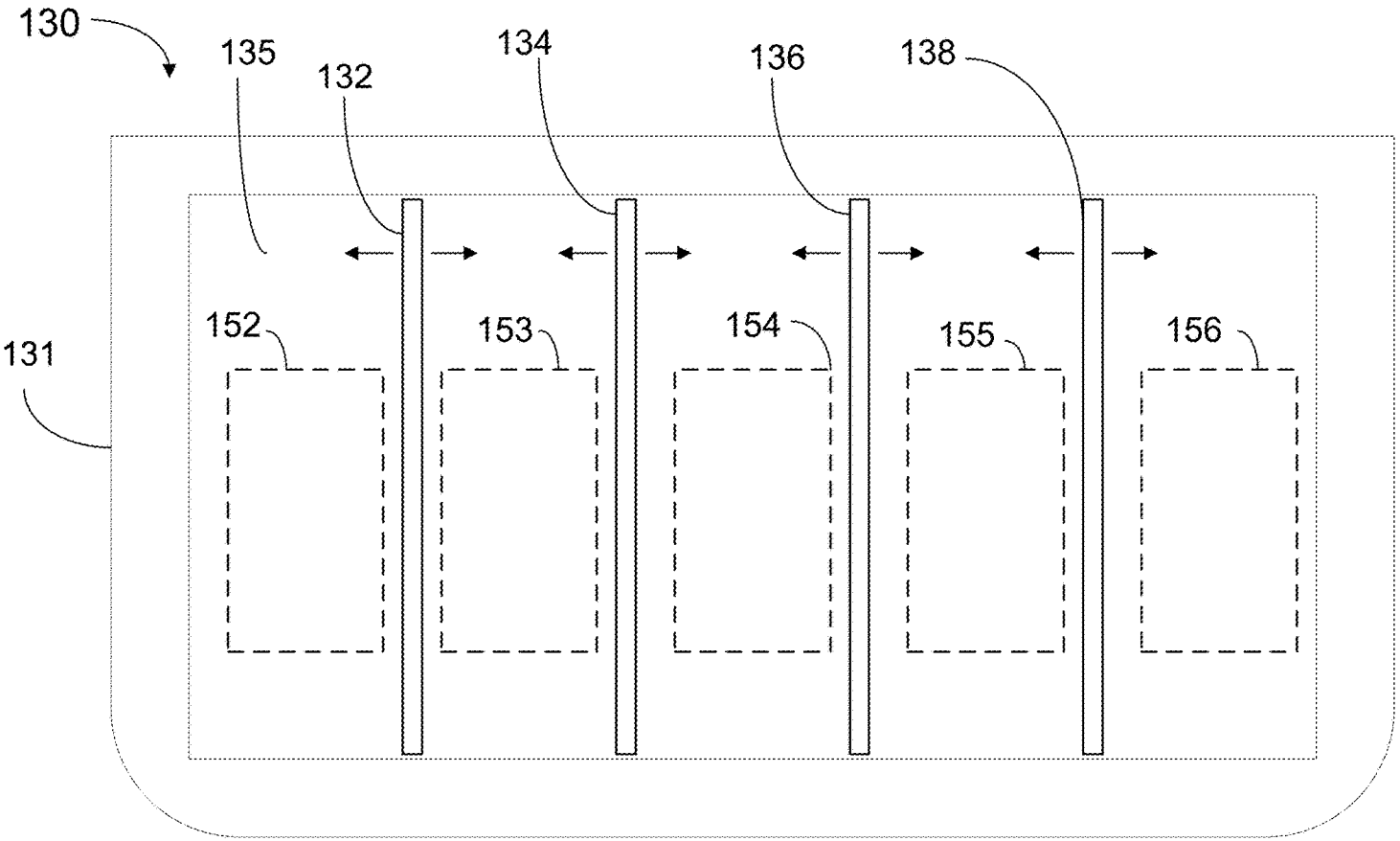
FIG. 3 is a schematic top view of an exemplary embodiment of a shelf unit according to the present invention.

FIG. 3 is a schematic top view of a lower shelf 130 in which an exemplary arrangement of display items is shown. As shown, shelf 130 includes a body 131 into which a central bottom surface 135 has been inset. The body 131 can be made from wood, plastic, a combination thereof or any other suitable material. The insert however is made from a magnetically permeable material such as stainless steel, as explained further below. On top of insert 135 a plurality of dividers 132, 134, 136, 138 are positioned, aligned from the front edge to the back edge of the insert 135. The spaces between the dividers define slots into which displayed item can be placed and provide a barrier beyond which the displayed items placed within the slots cannot move or shift horizontally. In this manner, the dividers maintain a consistent appearance of the displayed items on the shelf. In the example shown, an outlined footprint of exemplary display item 152 is shown in the slot between the left edge of surface 135 and divider 132, an outlined footprint of exemplary display item 153 is shown in the slot between dividers 132 and 134, an outlined footprint of exemplary display item 154 is shown in the slot between dividers 134 and 136, an outlined footprint of exemplary display item 155 is shown in the slot between dividers 136 and 138, and an outlined footprint of exemplary display item 156 is shown in the slot between divider 138 and the right edge of the insert. In the depicted example, the display items have approximately the same width and therefore the dividers are placed approximately evenly with respect to one another along the shelf. However, this is merely one example, and in general, a shelf can contain products of varying dimensions. The dividers can be moved and/or removed to accommodate the various dimensions of the products.

Figure 4:
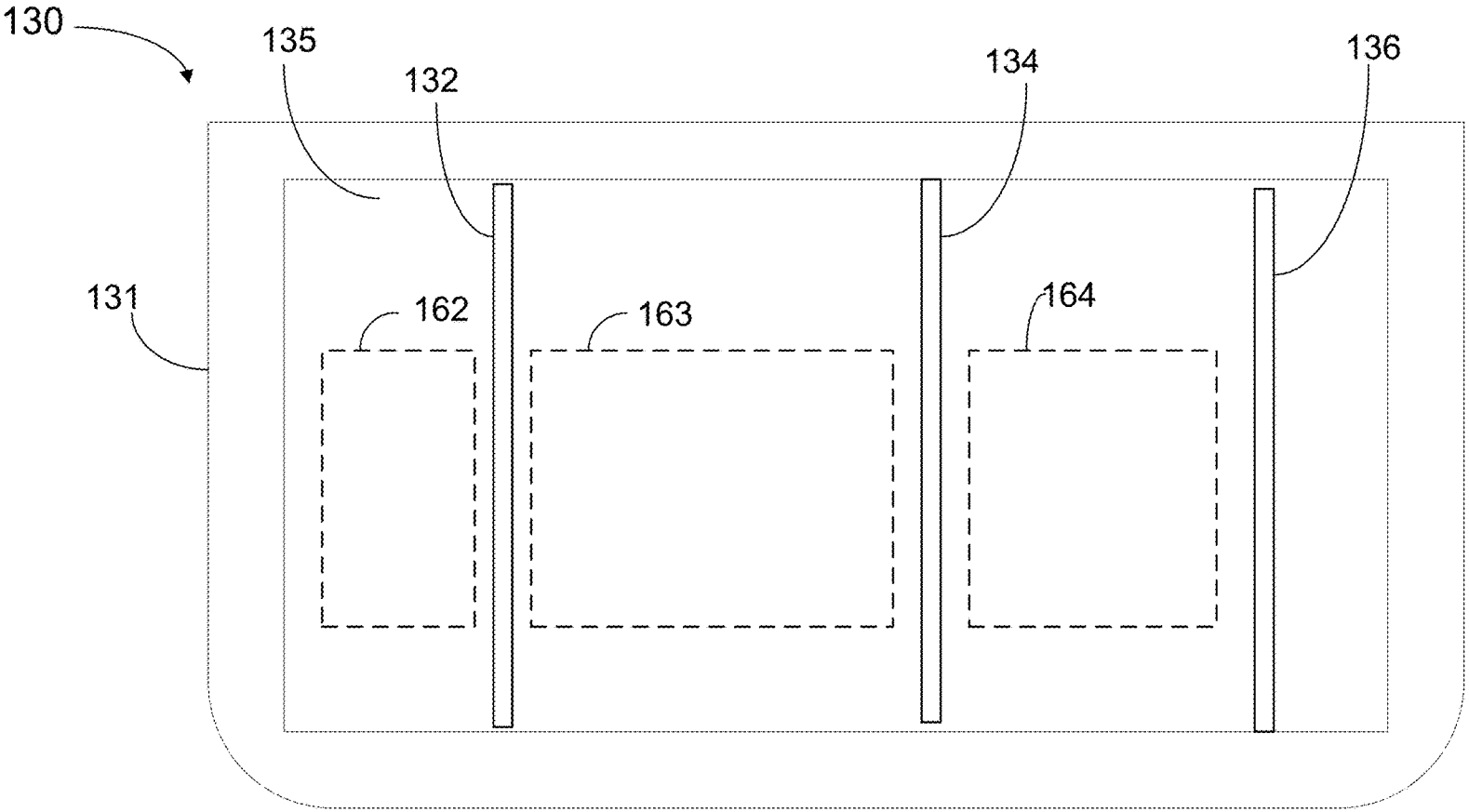
FIG. 4 is a schematic top view of the shelf unit as shown in FIG. 3, illustrating changed divider placements.

FIG. 4 shows a top view of a different arrangement in which display items of varying widths are displayed. As shown in FIG. 4, divider 132 is positioned a distance from the left edge of the insert to accommodate a display item 162 having a first width. Divider 134 is positioned a further distance away to accommodate display item 163 which has a second width greater than the first width of display item 163. Divider 136 is positioned at a distance from divider 134 to accommodate a display item 164 having a third width intermediate between the first and second widths of items 162, 163. Divider 138 present in FIG. 3 has been removed from the example shown in FIG. 4 as it is not needed in the arrangement of FIG. 4.

Figure 5:
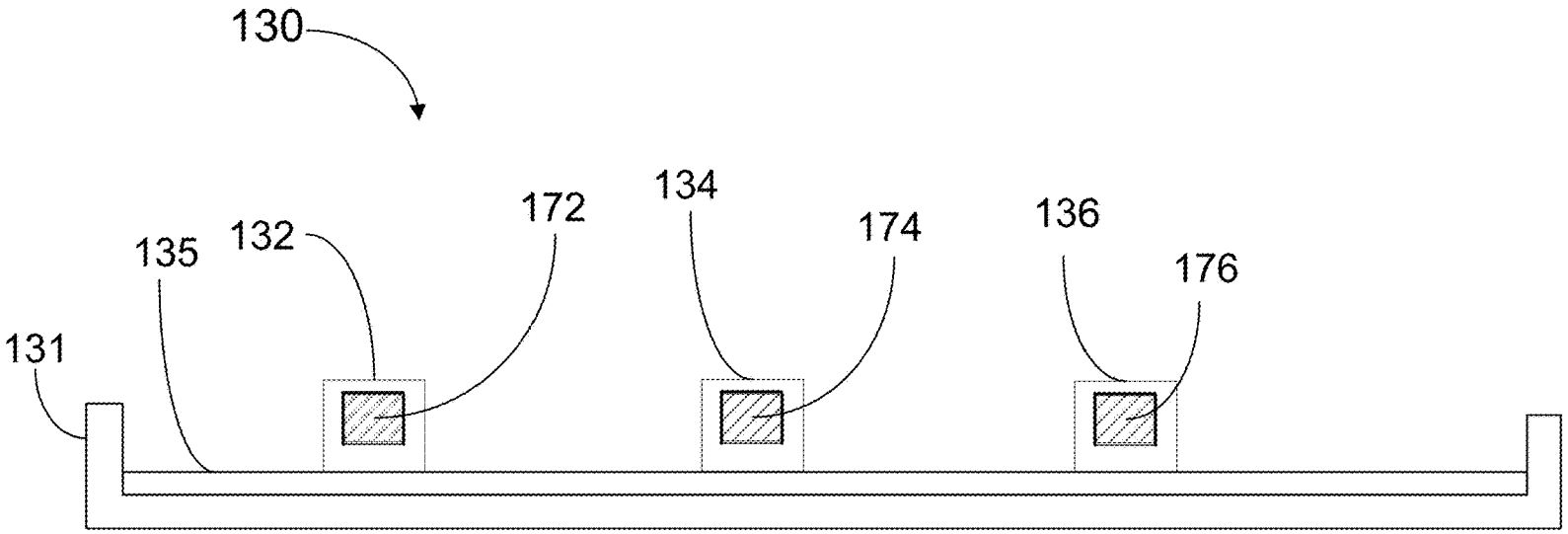
FIG. 5 is a schematic cross-sectional view of a shelf unit according to an exemplary embodiment of the present invention.

In the cross-sectional view of FIG. 5, the internal composition of the shelf and dividers are depicted in accordance with an embodiment of the invention. This view more clearly indicates how insert 135 is recessed below the height of the outer edges of the body 131 of the shelf. As noted above, the insert 135 is made of a magnetically permeable material, for example, a material including ferromagnetic components such as stainless steel. The cross-sectional view of FIG. 5 shows that the dividers 132, 134, 136 are not of uniform composition, and that each includes a respective magnet 172, 174, 176. The magnetic flux emanating from the magnetics 172, 174, 176 interacts with the magnetically permeable material of the insert 135, generating an attraction therebetween. By virtue of the magnetic attraction between the dividers 132, 134, 136 and the insert 135, the dividers remain in position on the surface unless a significant force is applied that overcomes the magnetic attraction, such as a manual, urging force to remove a particular divider. The magnetic attraction (i.e., the strength of the magnets) is selected to be sufficient that typical manipulation of the display items on or from the shelves, for example, for inspection or purchase, does not alter the position of the dividers.

Figure 6:
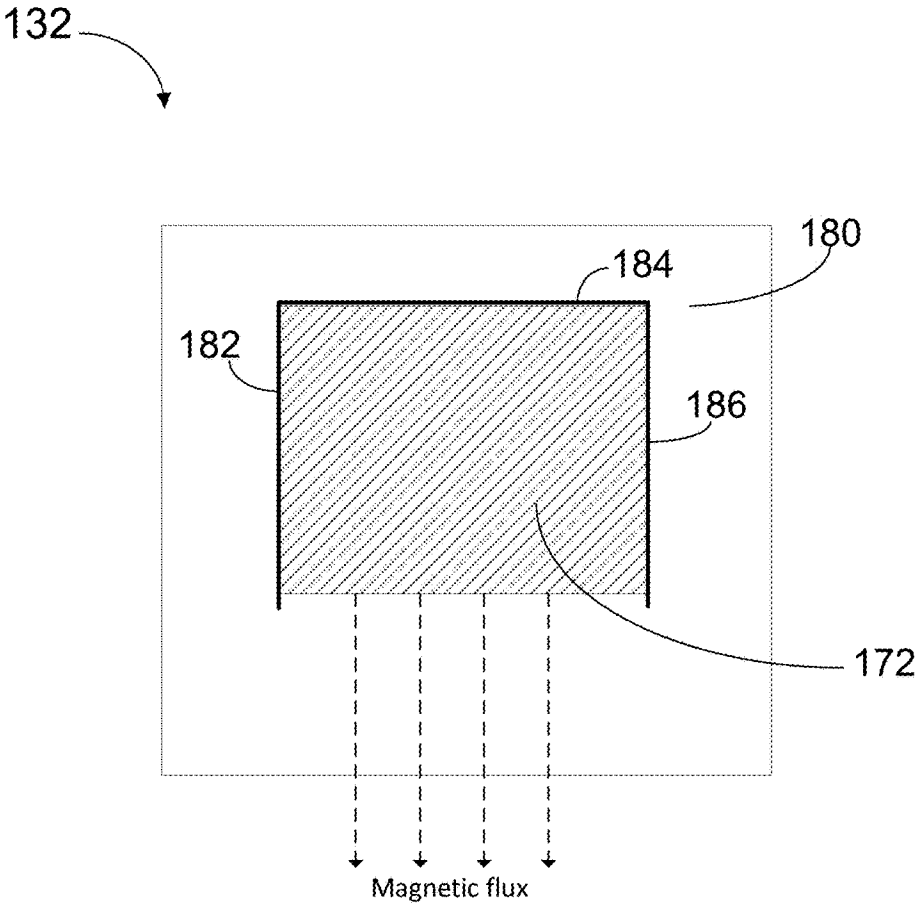
FIG. 6 is an enlarged schematic cross-sectional view of a divider according to an exemplary embodiment of the present invention.

Referring now to FIG. 6, an enlarged cross-sectional view of an embodiment of a divider according to the present invention is shown. Divider 132 has a rectangular cross-sectional profile although other shapes can be used that have a flat bottom surface, e.g. triangular. In the embodiment depicted, divider 132 includes a rectangular magnetic core 172 that is surrounded on three sides by a shielding having a first side 182, a second side 184 and a top 186; and both the magnet 172 and shielding 182, 184, 186 are enveloped by a cladding 180 composed of a non-magnetic material 180. The shielding components 182, 184, 186 comprise a layer of magnetically permeable material, such as a stainless steel or another ferromagnetic composition. The purpose of the shielding 182, 184, 186 is to block the magnetic flux of the magnet 172 from penetrating in horizontal or upward directions, and to ensure that the magnetic flux is therefore directed substantially only downwards toward the insert 135 as shown in the figure. As magnetic flux lines terminate at magnetically-permeable material of the shielding (i.e., the magnetizable material of the shielding adjusts to compensate the magnetic flux of the magnet), the shielding effectively block the magnet 172 from effecting object to the side of the divider 132 such as any adjacent products, such as electronic devices. In this manner, the magnets of the dividers function to keep the divider 132 in place, and maintain the consistent position and appearance of the displayed items, without causing any adverse effects. One suitable magnetically permeable material for the shielding is Mu-metal, which is a nickel-iron soft magnetic alloy with very high permeability suitable for shielding sensitive electronic equipment against static or low-frequency magnetic fields. It has several compositions. One such composition is approximately 77% nickel, 16% iron, 5% copper and 2% chromium or molybdenum.

It is noted that while the exemplary magnet 172 has a rectangular shape and the shielding is configured according to the rectangular shape of the magnet, the magnetic core of the dividers can take any shape, and can include magnetic material distributed non-uniformly within the divider. The shielding can take a curvilinear shape, and in some embodiments, can be positioned on the outer surface of the cladding, with care taken to ensure that the magnetic flux penetrates through the bottom surface of the divider.

It is to be understood that any structural and functional details disclosed herein are not to be interpreted as limiting the systems and methods, but rather are provided as a representative embodiment and/or arrangement for teaching one skilled in the art one or more ways to implement the methods.

It is to be further understood that like numerals in the drawings represent like elements through the several figures, and that not all components and/or steps described and illustrated with reference to the figures are required for all embodiments or arrangements.

The terminology used herein is for describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing, and are not to be construed as limiting. However, it is recognized these terms could be used with reference to a viewer. Accordingly, no limitations are implied or to be inferred.

Also, the phraseology and terminology used herein is for description and should not be regarded as limiting. The use of "including," "comprising," or "having," "containing," "involving," and variations thereof herein, is meant to encompass the items listed thereafter and equivalents thereof as well as additional items.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A shelf unit for a kiosk used for displaying items, comprising:

a shelf body having a recessed top surface defining a cavity within the shelf body;

an insert disposed within the cavity of the shelf body, the insert comprising a magnetically permeable material; and a plurality of dividers movably positionable on the insert, each divider including a magnet and a shielding material surrounding a substantial portion of each magnet, the shielding material redirecting magnetic flux emanating from each magnet toward the insert;

wherein the dividers are configured to maintain the items in respective positions on the insert while a magnetic attraction between the dividers and the insert secures the dividers in position.

2. The shelf unit of claim 1, wherein the magnetically permeable material of the insert comprises a stainless steel.

3. The shelf unit of claim 1, wherein the dividers are dimensioned to be horizontally moveable along the insert while maintaining a perpendicular orientation relative to the shelf body.

4. The shelf unit of claim 1, wherein the dividers are removable from the insert.

5. The shelf unit of claim 4, wherein the dividers are positionable on the insert to create uniform slots for placing the items on the shelf body therebetween.

6. The shelf unit of claim 4, wherein the dividers are moveable along the insert to abut and maintain the items in rows on the insert.

7. A kiosk for displaying items, comprising:

an illuminated display unit;

at least one shelf unit for holding the items, each shelf unit positioned beneath the illuminated display unit; each shelf unit including:

a shelf body having a recessed top surface defining a cavity within the shelf body;

an insert disposed within the cavity of the shelf body, the insert comprising a magnetically permeable material; and a plurality of dividers movably positionable on the insert, each of the dividers including a magnet and a shielding material surrounding a substantial portion of each magnet, the shielding material redirecting magnetic flux emanating from each magnet toward the insert;

wherein the dividers are configured to maintain the items in respective positions on the insert while a magnetic attraction between the dividers and the insert secures the dividers in position.

8. The kiosk of claim 7, wherein the magnetically permeable material of each insert of each shelf unit comprises a stainless steel.

9. The kiosk of claim 7, wherein the dividers of each shelf unit are dimensioned to be horizontally moveable along each insert respectively while maintaining a perpendicular orientation relative to each shelf body.

10. The kiosk of claim 7, wherein the dividers of each shelf unit are removable from each insert respectively.

11. The kiosk of claim 10, wherein the dividers are positionable on each insert of each shelf unit to create uniform slots for placing the items on each shelf unit respectively therebetween.

12. The kiosk of claim 10, wherein the dividers are moveable along each insert each shelf unit respectively to abut and maintain the items in rows on each insert.

* * * * *